United States Patent [19]

Scelba

[11] Patent Number: 4,569,213

[45] Date of Patent: Feb. 11, 1986

[54] COMPARTMENT CLOSURE ASSEMBLY WITH LATCHING APPARATUS HAVING COMBINATION LOCK

[75] Inventor: Stephen S. Scelba, Clifton, N.J.

[73] Assignee: Presto Lock, Inc., Garfield, N.J.

[21] Appl. No.: 585,369

[22] Filed: Mar. 2, 1984

[51] Int. Cl.[4] ..... E05B 65/44

[52] U.S. Cl. ..... 70/84; 70/312

[58] Field of Search ..... 70/84, 85, 86, 87, 88, 70/312; 292/99, 198, 216

[56] References Cited

U.S. PATENT DOCUMENTS

| | | | |
|---|---|---|---|
| 2,344,532 | 3/1944 | Brantingson | 292/198 |
| 2,750,786 | 6/1956 | Sanowskis | 70/313 |
| 3,581,532 | 6/1971 | Anderson | 70/84 |
| 3,691,799 | 9/1972 | Hoffmann | 70/84 |
| 4,177,656 | 12/1979 | Davis | 70/84 |
| 4,366,685 | 1/1983 | Remington | 70/70 |
| 4,389,863 | 6/1983 | Bako | 70/312 |

*Primary Examiner*—Robert L. Wolfe

*Attorney, Agent, or Firm*—Shapiro and Shapiro

[57] ABSTRACT

A closure, which may be part of a glove compartment drawer of an automobile, is controlled by a latch pivotally supported on a base that also supports a combination lock. When the lock is set to its unlocking combination, the latch is permitted to move from a latched position and is moved toward its unlatched position by cooperable camming formations on the latch and the closure.

12 Claims, 3 Drawing Figures

COMPARTMENT CLOSURE ASSEMBLY WITH LATCHING APPARATUS HAVING COMBINATION LOCK

BACKGROUND OF THE INVENTION

This invention is concerned with closure assemblies, such as those employed on the glove compartments of automobiles, and is more particularly concerned with a closure latching apparatus controlled by a combination lock.

For many years complex and expensive latching apparatus controlled by combination locks have been used for controlling the locking and unlocking of a wide variety of closures, such as the doors of safes, buildings, and automobiles. In the last decade relatively inexpensive combination locks have been widely used in the luggage industry for controlling the locking and unlocking of luggage cases, such as attache cases for example. There are many other industries where moderate security requirements would permit the use of inexpensive combination locks of the type employed in the luggage industry, but problems in adapting such combination locks to other industries have tended to limit their application.

BRIEF SUMMARY OF THE INVENTION

The present invention provides a simple and inexpensive latching apparatus that may be readily controlled by a combination lock of a type widely used in the luggage industry, and that readily controls the locking and unlocking of a compartment closure, such as the door of a glove compartment of an automobile. In one of its broader aspects, a latching apparatus for a closure and the like in accordance with with invention comprises a base, a lock supported on the base and having control means exposed at one side of the base, a latch supported on the base at the opposite side thereof for pivotal movement between a latched position and an unlatched position, the lock having means for blocking movement of the latch from its latched position to its unlatched position until the lock is unlocked by the control means, and the latch having means for moving the latch between the positions when the lock is unlocked.

DESCRIPTION OF THE PREFERRED EMBODIMENT

Figure 1:
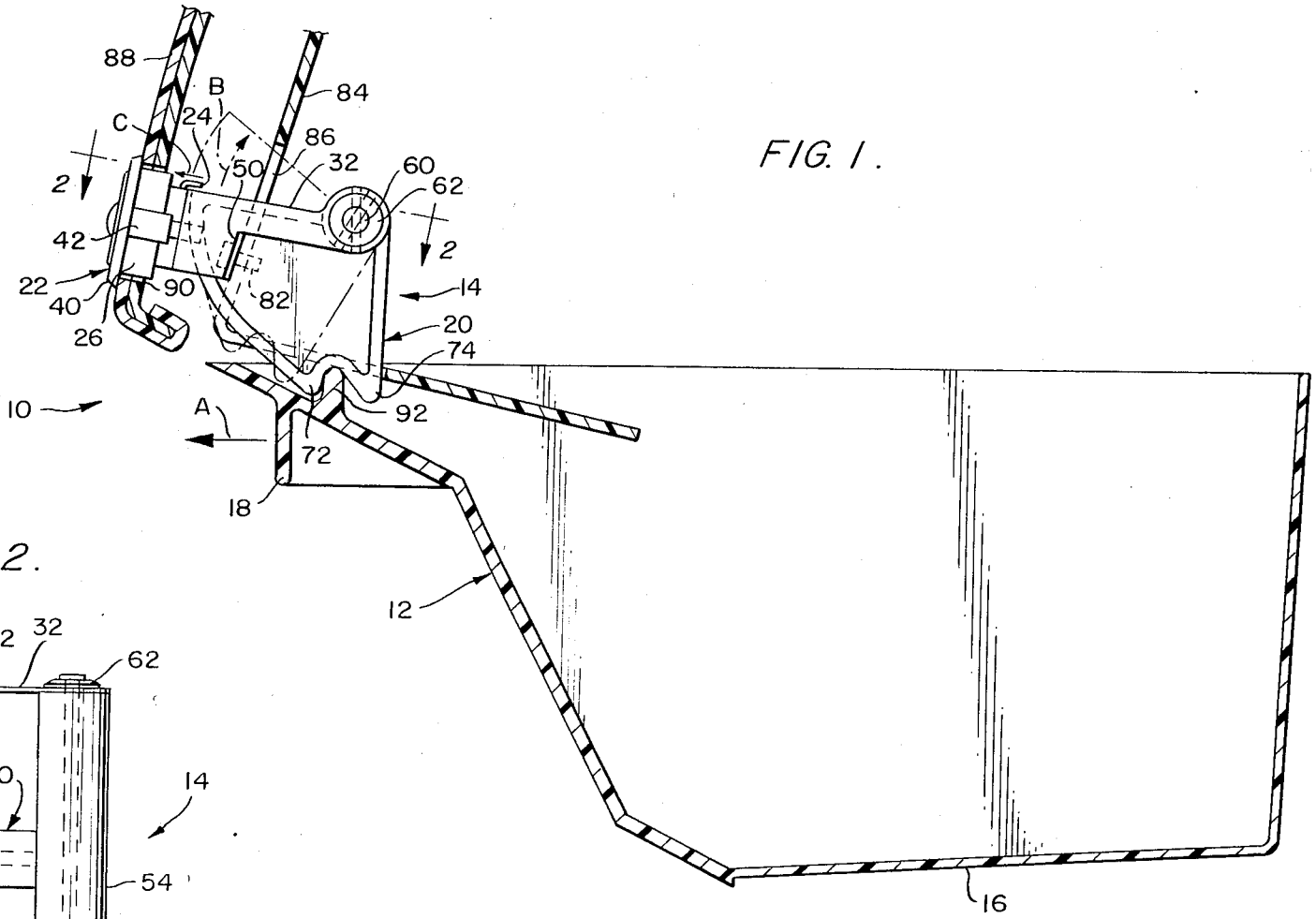
FIG. 1 is a longitudinal sectional view illustrating a closure assembly of the invention as employed on an automobile glove compartment.

As shown in FIG. 1, a closure assembly 10 in accordance with the invention comprises a closure 12 and latching apparatus 14. In the form shown the closure is integral with a drawer 16 supported in an appropriate manner, well known, for opening movement in the direction of arrow A and for closing movement in the opposite direction, i.e., essentially left and right in FIG. 1. Drawer 16 may be the receptacle of an automobile glove compartment. Alternatively, the compartment itself may be fixed and closure 12 movable to provide access to the compartment, as by mounting the closure on hinges at the lower end, for example, as is well known. Closure 12 may have a handle 18 for moving the closure manually.

The latching apparatus 14 comprises a latch 20 supported for pivotal movement between a latched position shown in full lines in FIG. 1 and an unlatched position shown in phantom lines, the direction of movement being indicated by arrow B. A lock 22 includes blocking means 24 that prevents movement of latch 20 to its unlatched position until the blocking means has been moved in the direction of arrow C by operation of the lock, as will be described. The latching apparatus includes a base 26 that supports both the lock 22 and the latch 20.

Figure 3:
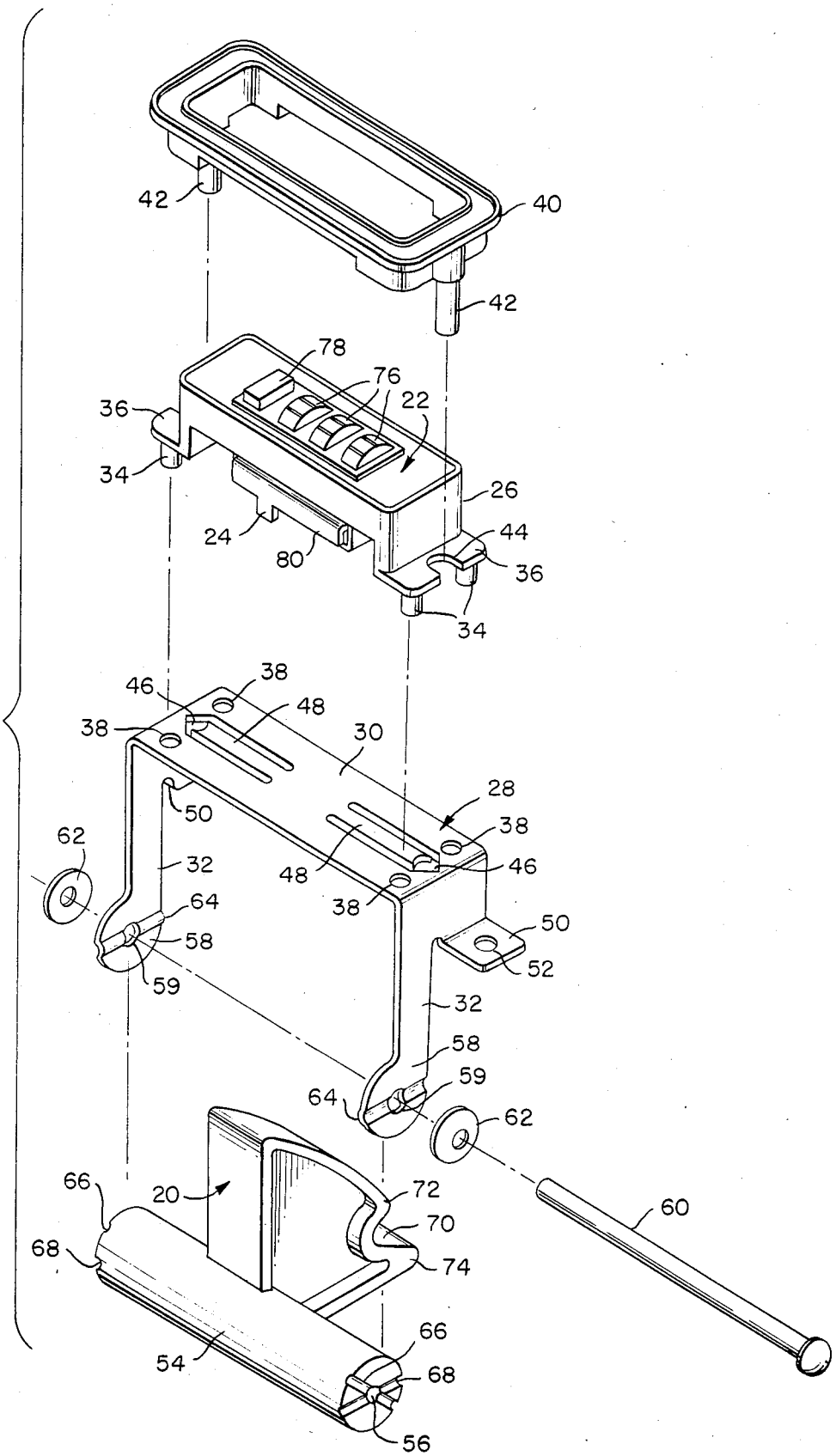
FIG. 3 is an exploded perspective view of latching apparatus of the invention.

As shown in FIG. 3, in the preferred form the base 26 comprises the casing of a combination lock 22. A yoke 28 for supporting the latch 20 may have a base portion 30 and a pair of projecting arms 32. The base portion may be attached to casing 26 of the lock by rivets 34 formed integrally on flanges 36 of the casing and passed through holes 38 on the base portion. The lock may have an escutcheon plate 40 adapted to surround the casing 26, and the escutcheon plate may have cylindrical bosses 42 that extend through notches 44 in flanges 36 and then through openings 46 in the yoke 28. The yoke may be formed of resilient metal, and openings 46 may be provided at the ends of resilient cantilevered teeth 48 punched out of the base portion 30 in the configuration illustrated. As is well known, if the bosses 42 of the escutcheon plate are formed of plastic, for example, and if openings 46 are initially slightly smaller in cross-section than the bosses, the bosses may be forced into the openings, depressing the teeth 48 slightly. The metal defining the openings 46 bites into the boss material and resists withdrawal of the bosses from the openings. Yoke 28 may have a pair of outwardly projecting flanges 50 with holes 52 that receive fasteners for attaching the yoke to a support as will be described.

In the form shown, the latch 20 has a mounting portion 54 constituted by a cylindrical rod with a longitudinal bore 56. The ends of the rod are adapted to engage corresponding inner surfaces of enlarged ends 58 of arms 32 of the yoke. A pivot pin 60 may then be inserted through the bore 56 via holes 59 in arms 32, a washer 62 preferably being provided at the outer surface of each arm. Pin 60 may be retained in any well known manner, as by expanding its free end.

In the form shown, arms 32 are provided with internal ridges 64 adapted to enter either of a pair of corresponding recesses 66, 68 at the ends of rod 54. By virtue of the resiliency of arms 32, this arrangement provides a detent action, so that latch 20 may be releasably held in its latched and unlatched positions (see FIG. 1). However, it will become apparent hereinafter that in use the latch need only be releasably held in its unlatched position (as by resilient means) since the cooperation of the latch with the closure ensures that the latch is releasably held at its latched position.

As shown in FIG. 3, the major portion of the latch has a sectoral shape, although other appropriate shapes may be employed. An outer portion of the latch has a recess 70 between a pair of protrusions 72 and 74, the purpose of which will become apparent later.

Combination lock 22 is preferably of a type widely used in luggage hardware. The mechanism of the lock may, for example, be of the type disclosed in U.S. Pat.

No. 4,389,863, issued June 28, 1983, and assigned to the same assignee as the present invention, the disclosure of which is incorporated herein by reference. The lock includes indicia bearing combination dials 76 (control means) that are exposed through corresponding slots in a faceplate of the lock, and a shift member 78 that may be manipulated after the lock has been unlocked to permit the dials to select a new unlocking combination. A bolt 80 is supported along an edge thereof for pivotal movement about an axis parallel to the rotational axis of the combination dials, and parallel to the pivotal movement of the latch 20. Blocking means 24 (previously) referred to in connection with FIG. 1) is preferably integral with the bolt at the edge opposite to the pivotal support edge. When the lock is set to the unlocking combination, the bolt is moved by a spring of the lock mechanism to withdraw the blocking means 24 from the path of latch 20, as indicated by arrow C in FIG. 1 and in FIG. 2.

Figure 2:
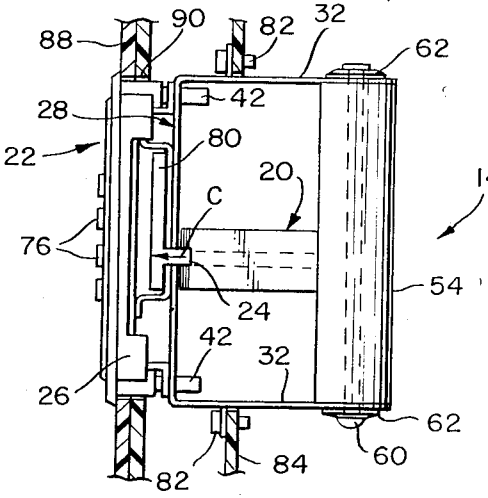
FIG. 2 is a sectional view taken along line 2—2 of FIG. 1 and illustrating latching apparatus of the invention.

FIGS. 1 and 2 illustrate how the latching apparatus 14 may be mounted adjacent to the closure 12. As shown, fasteners such as screws 82 passed through flanges 50 of the yoke 28 may attach the yoke to a panel 84 adjacent to the glove compartment of an automobile. An opening 86 in the panel accommodates the arms 32 of the yoke, as well as the pivotal movement of latch 20. An outer panel 88 spaced from panel 84 has an opening 90 that accommodates the casing 26 of the combination lock, the opening being framed by the escutcheon plate 40. Thus the entire latching assembly, as a unit, is easily mounted adjacent to the closure 12.

Recess 70 and protrusions 72 and 74 of latch 20 constitute camming formations on the latch that cooperate with a protrusion 92 constituting a camming formation on the closure. In the use of the invention, when the combination lock has been set to the unlocking combination so as to withdraw blocking means 24 from the path of movement of latch 20, closure 12 may be moved in the direction of arrow A, turning latch 20 about the axis of pin 60 (transverse to the movement of the closure) in the direction of arrow B, by virtue of the cooperable camming formations 72 on the latch and 92 on the closure. The closure may be moved to the extent required to gain access to the compartment controlled thereby. When the closure is moved in the opposite direction to close the compartment, protrusion 92 will engage protrusion 74 and return latch 20 to its latched position shown in full lines in FIG. 1. If the dials of the combination lock are then set offcombination, blocking means 24 will be reinserted into the path of latch 20, thereby preventing movement of the latch to its unlatched position and maintaining the closure in its locked position.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. Latching apparatus for a closure and the like comprising a base, a combination lock supported on said base and having control means exposed at one side of said base, a latch supported on said base at the opposite side thereof for pivotal movement about an axis between a latched position and an unlatched position, said lock having a bolt supported for pivotal movement about an axis parallel to the axis of the pivotal movement of said latch, said bolt having means for blocking movement of said latch from its latched position to its unlatched position until said lock is unlocked by said control means, and said latch having means for moving the latch between said positions when said lock is unlocked.

2. Apparatus in accordance with claim 1, wherein said means for moving said latch comprises a camming formation on said latch cooperable with said closure.

3. Apparatus in accordance with claim 1, wherein said latch has means for releasably holding the same at its unlatched position.

4. Apparatus in accordance with claim 1, wherein said control means comprises a plurality of dials arranged for rotation about an axis parallel to the previously mentioned axes.

5. Apparatus in accordance with claim 1, wherein the pivotal movement of said latch is entirely on said opposite side of said base and said blocking means projects into the path of said pivotal movement of said latch to block the same.

6. A closure assembly comprising a closure and latching apparatus therefor, said latching apparatus comprising a base, a combination lock supported on said base and having control means exposed at one side of said base, a latch supported on said base at the opposite side thereof for pivotal movement about an axis between a latched position and an unlatched position, said lock having a bolt supported for pivotal movement about an axis parallel to the axis of the pivotal movement of said latch, said bolt having means for blocking movement of said latch from its latched position to its unlatched position until said lock is unlocked by said control means, said latch and said closure having cooperable means for holding said closure closed when movement of said latch from its latched position is blocked by said blocking means.

7. A closure assembly in accordance with claim 6, wherein said control means comprises a plurality of dials arranged for rotation about an axis parallel to the previously mentioned axes.

8. A closure assembly in accordance with claim 6, wherein the pivotal movement of said latch is entirely on said opposite side of said base and said blocking means projects into the path of said pivotal movement of said latch to block the same.

9. A closure assembly in accordance with claim 6, wherein said latch and said closure have cooperable means for moving said latch toward its unlatched position as said closure is opened and for moving said latch toward its latched position as said closure is closed.

10. A closure assembly in accordance with claim 9, wherein the last-mentioned cooperable means comprises camming formations on said latch and said closure, respectively.

11. A closure assembly in accordance with claim 10, wherein said camming formation on said latch comprises a recess between a pair of protrusions and said camming formation on said closure comprises a protrusion adapted to be engaged in said recess.

12. A closure assembly in accordance with claim 11, wherein said closure is part of a drawer movable in a predetermined opening direction and wherein the pivotal movement of the latch is about an axis transverse to said direction.

* * * * *